US007089708B1

(12) United States Patent
Bostock

(10) Patent No.: US 7,089,708 B1
(45) **Date of Patent: *Aug. 15, 2006**

(54) WALL PANELING ASSEMBLY AND SYSTEM

(75) Inventor: Glenn H. Bostock, Hatboro, PA (US)

(73) Assignee: Bostock Company, Inc., Pipersville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/490,268

(22) Filed: Jan. 24, 2000

Related U.S. Application Data

(63) Continuation of application No. 09/235,620, filed on Jan. 22, 1999, now abandoned.

(51) Int. Cl.
*E04F 13/08* (2006.01)

(52) U.S. Cl. ..... 52/392; 52/592.1; 52/539; 52/541; 52/535

(58) Field of Classification Search ..... 52/578, 52/588.1, 519, 548, 489.1, 489.2, 592.4, 52/590.3, 592.1, 392, 403.1, 539, 541, 480, 52/506.5, 535, 506.01, 506.05, 314, 311.2, 52/316

See application file for complete search history.

(56) References Cited

U.S. PATENT DOCUMENTS

| | | | | |
|---|---|---|---|---|
| 304,584 | A | 9/1884 | Tunis | |
| 1,374,082 | A | 4/1921 | Hedges | |
| 2,200,649 | A | 5/1940 | Wardle | |
| 2,216,271 | A | 10/1940 | Joiner | |
| 2,898,640 | A * | 8/1959 | Dail | 52/506.06 |
| 3,187,389 | A * | 6/1965 | Anderson | 52/489.1 |
| 3,200,553 | A * | 8/1965 | Frashour | 52/592.4 |
| 3,237,360 | A | 3/1966 | Mills | |
| 3,331,180 | A | 7/1967 | Vissing et al. | |
| 3,347,048 | A * | 10/1967 | Brown et al. | 405/16 |
| 4,100,710 | A * | 7/1978 | Kowallik | 52/309.9 |
| 4,593,513 | A | 6/1986 | Stratton | |
| 5,570,554 | A * | 11/1996 | Searer | 52/539 |
| 5,613,337 | A | 3/1997 | Plath et al. | |
| 5,787,669 | A | 8/1998 | Bishop | |
| 6,237,295 | B1 * | 5/2001 | Ballard | 52/589.1 |
| 6,606,834 | B1 * | 8/2003 | Martensson et al. | 52/578 |
| 6,851,237 | B1 * | 2/2005 | Niese et al. | 52/480 |

* cited by examiner

*Primary Examiner*—Daniel P. Stodola
*Assistant Examiner*—Nahid Amiri
(74) *Attorney, Agent, or Firm*—Synnestvedt & Lechner LLP

(57) ABSTRACT

Panels which are joined at their opposing end faces are used to create a panel assembly. The opposing end faces may be a tongue and groove arrangement or they may consist of matching beveled recesses. In either case, the interrelationship between the opposing end faces is such that, upon assembly, an intervening space is created between adjoining panels. This intervening space eliminates the cantilever force effect associated with known panel assemblies and it results, instead, in a shear force which is evenly distributed over the full extent of the abutting panel faces.

8 Claims, 5 Drawing Sheets

FIG.6
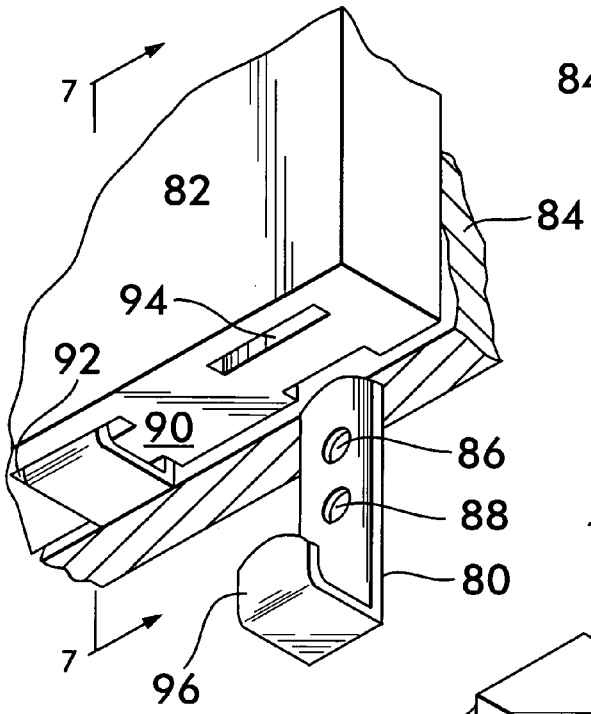
FIG.7
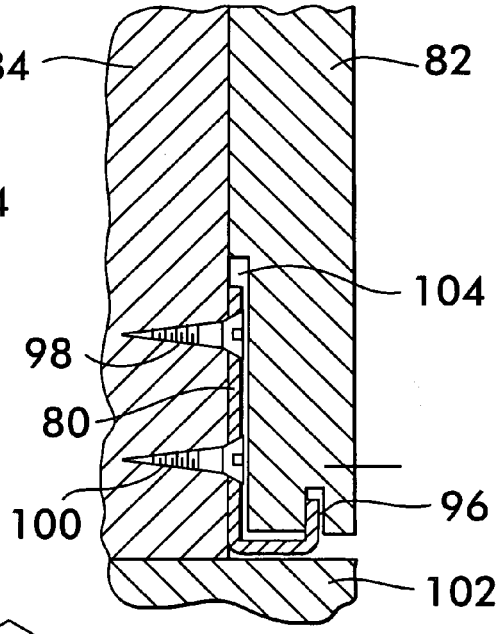
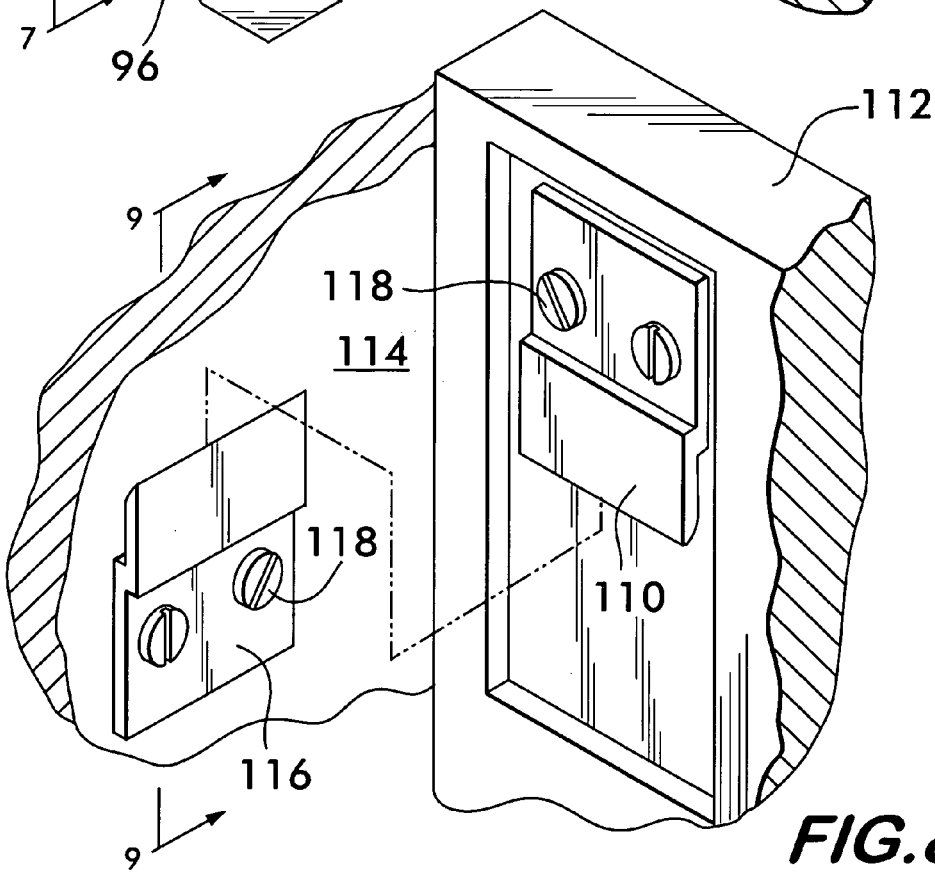
FIG.8

FIG.9
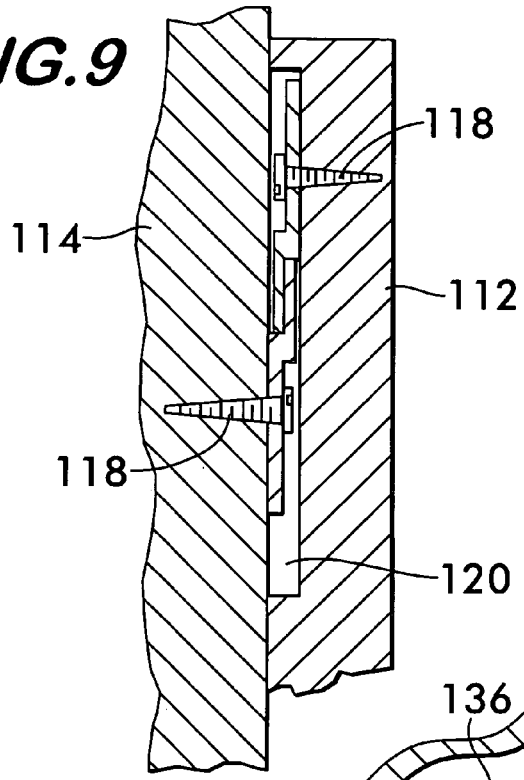
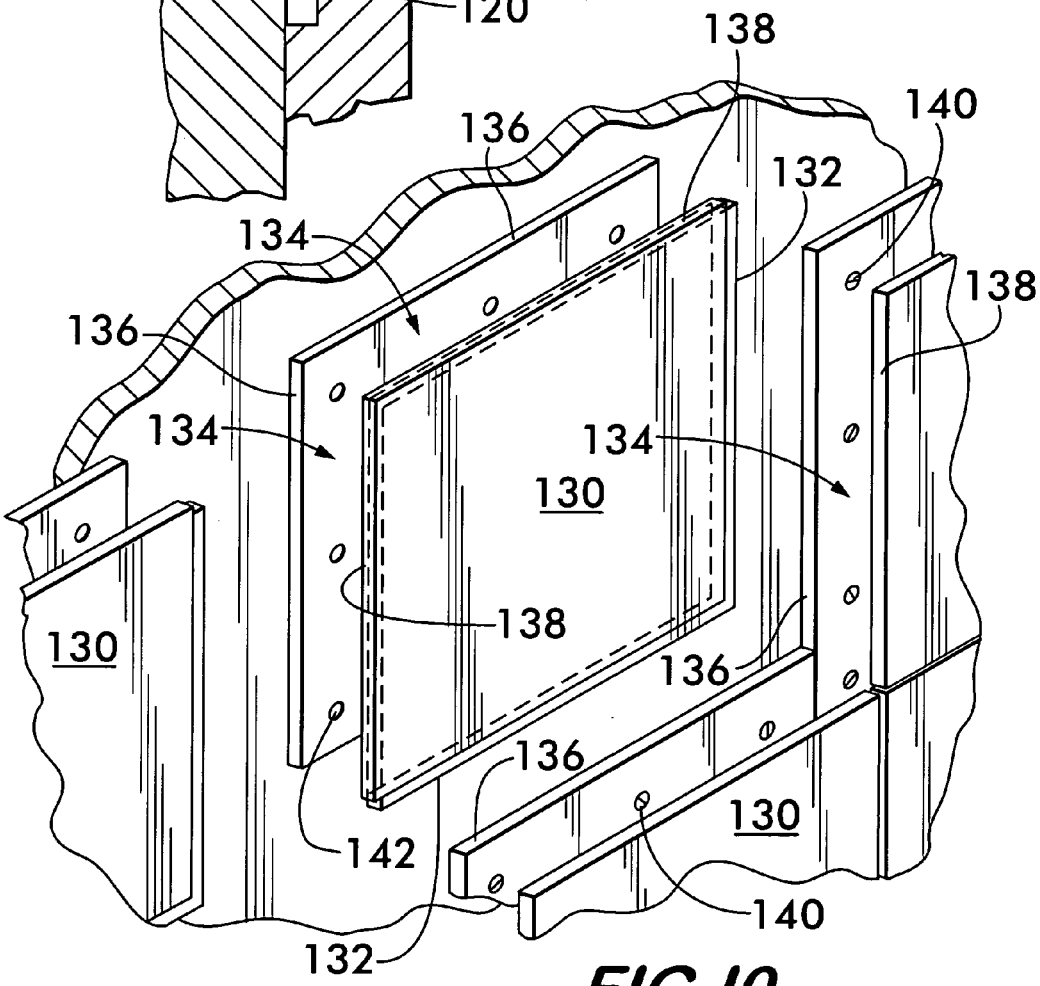
FIG.10

FIG.11
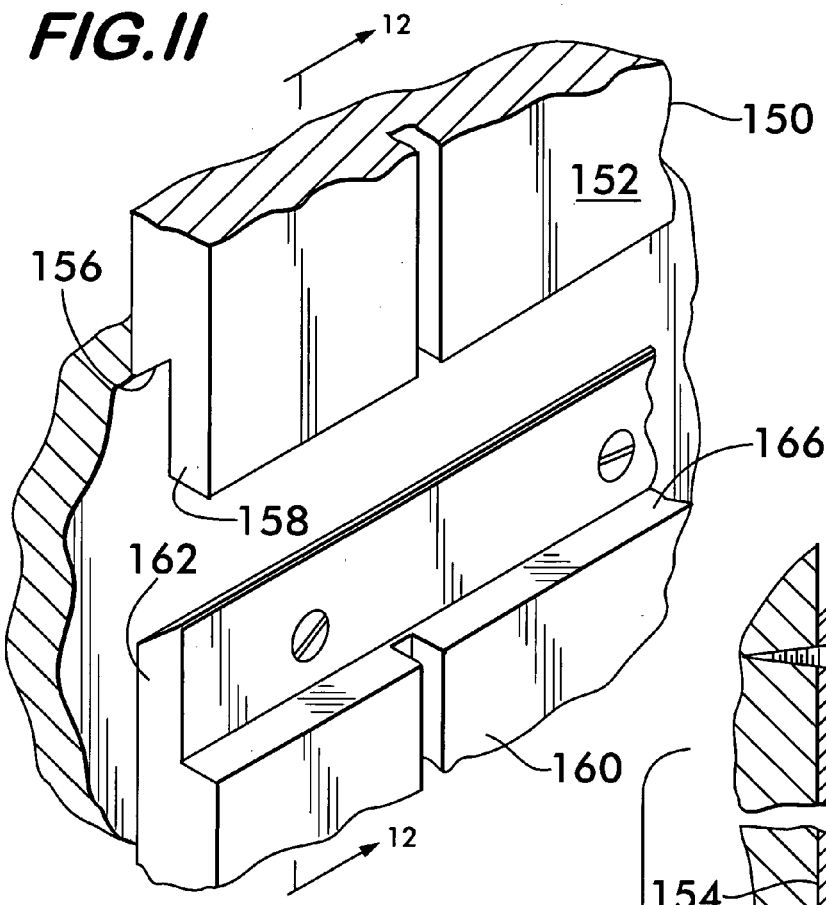
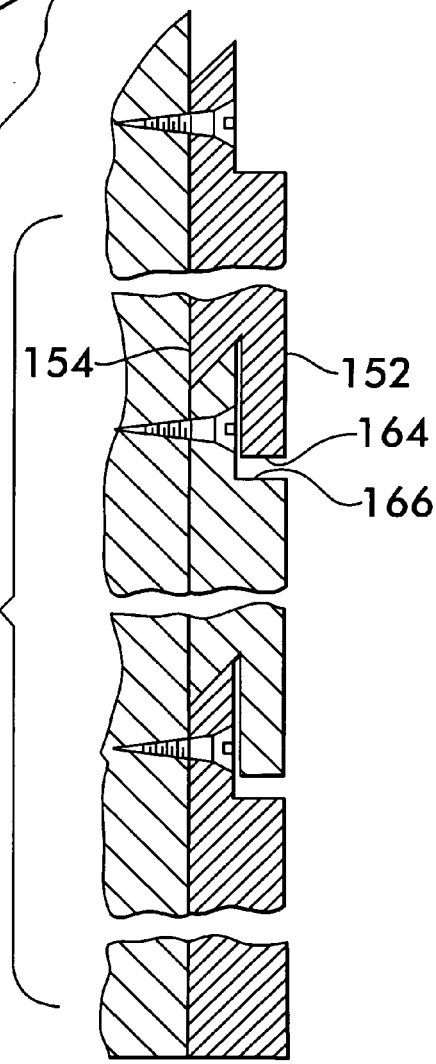
FIG.12

WALL PANELING ASSEMBLY AND SYSTEM

CROSS-REFERENCE TO RELATED APPLICATION

This application is a continuation under of a application Ser. No. 09/235,620, filed Jan. 22, 1999, now abandoned.

This invention relates to a novel wall paneling system and to a method for its assembly.

More particularly, this invention relates to wall panels which are configured to be joined to any number of like-configured panel pieces via a unique interlocking arrangement.

This invention can be used to create panel assemblies of all types; however, it is especially suitable for use in elevators whose sides are framed. Also, it can be secured directly onto studs without the need for an underlying drywall.

BACKGROUND OF THE INVENTION

There are several known systems for creating wall panel assemblies in homes, offices and elevators.

Systems which are most commonly used in elevators include, for example:

(1) Panels secured to a support structure by the use of Z-clips;

(2) Panels which are adhesively secured to a wall, including walls fabricated from extruded aluminum supports; and (3) Panels which employ an extruded spline-type fastening system.

Walls constructed with permanence as, for example, walls in homes and buildings, usually employ a drywall secured to studs. Once the drywall has been put in place, paneling, plaster or other coverings such as paint, may be used to enhance its appearance.

The present invention is an improvement over known systems because it provides for panels which can be interlockingly joined to one another, and to a support structure, including drywall, with relative ease. Moreover, this invention allows a user to remove individual panels and/or disassemble the entire system with a facility that is not possible with known systems.

OBJECT OF THE INVENTION

It is an object of this invention to provide panel pieces which can be interlockingly joined to one another so as to create a paneling system which is convenient, secure and easily disassembled.

A preferred object provides for the paneling of elevators where panel pieces are usually large and installation is labor intensive. The present invention overcomes these difficulties by providing panels whose interlocking abilities make it possible for an installer to assemble large panels with a facility and economy which was not heretofore possible.

SUMMARY OF THE INVENTION

The panel pieces of this invention are joined to one another by the unique interlocking engagement of their respective end segments and they can be secured to any type of support structure as, for example, an existing wall, a wall frame, wall studs or the like. Moreover, the panels may be joined to one another in a horizontal arrangement, a feature which makes them uniquely suitable for installing wall panels in an elevator.

In its broadest aspects, the panels of this invention are equipped with opposing end segments which matingly engage the like-configured segments of an adjacent panel piece. Each panel piece is comprised of a front side, a rear side and opposing edge faces which interlockingly engage the edge faces of a like-configured panel. In this embodiment, an edge face is formed to include an elongate projection or tongue and an opposing edge face is formed to contain an elongate recess or groove.

Moreover, it is a feature of this invention that the depth of the recess be of such dimension as to exceed the length of the projection.

As a result, the panel pairs will combine in such manner that the projection end of one panel does not come into contact with the recessed base of the adjoining panel and there is formed instead (between the projection end and recessed base) an elongate space which extends inwardly from the respective ends of each opposing side face. This elongate space is sometimes referred to hereinafter as an accent line.

Accordingly, it will be seen that a point of novelty in this invention lies in the configuration of each panel's opposing edge face. These edge faces are configured to matchingly engage the edge faces of like-configured panels so that they can be joined to one another to create a panel system.

Conversely, a paneled system can be disassembled by simply withdrawing the panel pieces one from the other.

According to one embodiment of this invention, the opposing faces of each panel are a tongue and groove and adjacent panels are joined to one another by bringing into engagement the tongue of one panel with the groove of an adjacent panel.

In this tongue and groove arrangement, it is essential that the groove be greater in depth than the length of the tongue so that the joining of one panel to another will result in an elongate space or accent line where the panel pieces engage one another.

In this assembly, the tongue and groove configuration may appear on a panel piece as one pair only, that is, on opposing sides of a panel or, alternatively, they may exist in tandem, that is, opposite one another, on all four sides of the panel piece. An illustration of this tandem arrangement is illustrated in the drawings in FIG. 10.

Another embodiment provides for a panel assembly in which the panel piece is characterized by a single tongue on one edge and a single groove on the opposing edge. In this embodiment, the panel piece is also comprised of a front side, a rear side and a pair of opposing edge faces for interlockingly engaging the edge faces of a like-configured panel; one edge face being a tongue and the second edge face being a groove which is defined by a rear leg, a front leg and a base member, with the proviso that the rear leg be greater in length than the front leg.

The tongue and groove have predetermined lengths and depths such that the depth of the groove is greater than the length of the tongue, as a result of which, in their assembled mode, a space is formed in situ between the tongue end and the base of the groove.

Still another embodiment provides for a panel piece in which the opposing edge faces are characterized by beveled recesses which are intended for matching engagement with the beveled faces of a second panel piece.

In this arrangement, the panel is also comprised of a front side and a rear side; however, the two opposing edge faces are formed with beveled edges, one edge face being formed with a beveled recess which extends from one side of the panel piece to the other; this recess being defined by a projecting first flange whose outer wall is coextensive with the rear side of the panel piece.

A second opposing edge face also contains a beveled recess which matches the beveled recess of the first edge face; this recess is defined by a projecting flange, the length of which is greater than that of the first flange so that in joining together two panel pieces there is formed between the adjoining panels an elongate space or accent line.

The virtue of this invention resides in the elimination of that cantilever force effect, which is associated with known panel systems. This cantilever effect results when the tongue end of one panel comes into contact with the base of the groove in an adjoining panel. The present invention eliminates this cantilever effect by transferring the exerted force onto the rear leg and shoulder of the adjoining panel pieces. The result is a shear force which distributes itself evenly onto the abutting portions of the joined panels and, also, onto the fastening means employed. As a result, the integrity of the panels is enhanced and they are less likely to fracture.

Also, in this arrangement, the assembled panels are not rigidly held and, instead, they are flexible and have the ability to shift slightly and thus avoid splitting. Moreover, when the panel pieces of this invention are attached to a support structure by screw means, they are removable and can be easily replaced.

BRIEF DESCRIPTION OF THE DRAWINGS

FIG. 6 is a fragmentary perspective view of a bottom panel piece shown with fastening devices in various stages of engagement.

FIG. 7 is a cross-sectional side view of the bottom panel of FIG. 6 taken along line 7—7.

FIG. 8 is a fragmentary perspective view of a panel piece equipped with a Z-clip fastening device.

FIG. 9 is a cross-sectional side view of the panel piece and Z-clip device of FIG. 8 taken along line 9—9.

FIG. 10 is a partial isometric view of a panel piece being inserted into a panel assembly.

FIG. 11 is a fragmentary isometric view of two unassembled panel pieces in which the opposing edge faces are beveled.

FIG. 12 is a cross-sectional assembled side view of FIG. 11 taken along line 12—12.

DETAILED DESCRIPTION OF THE PREFERRED EMBODIMENTS

Figure 1:
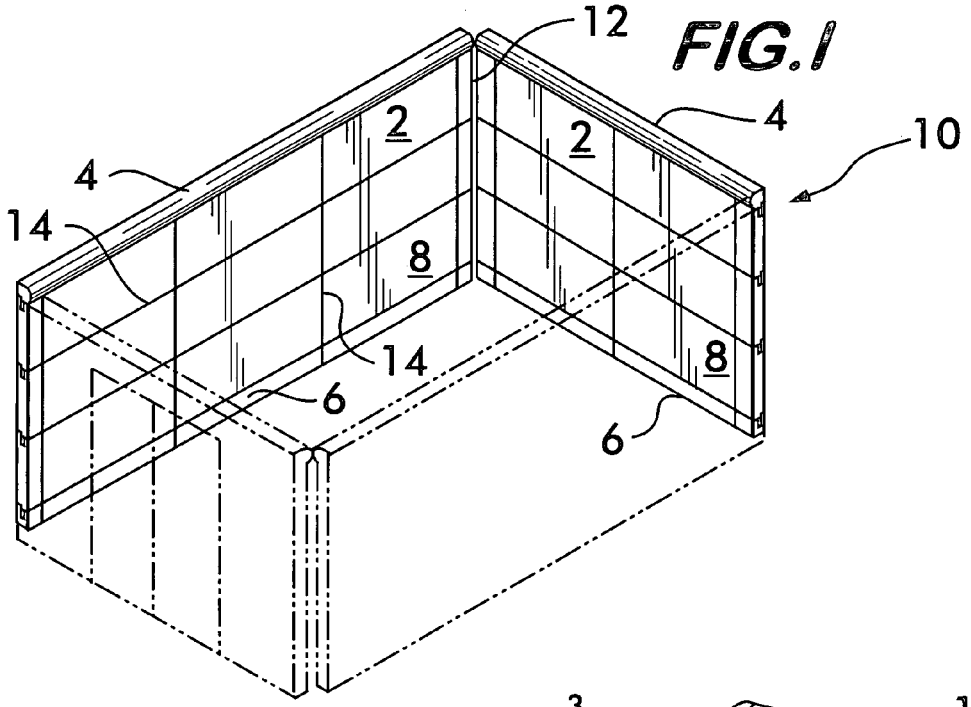
FIG. 1 is perspective view showing the paneling assembly of this invention installed in an elevator (in phantom).

FIG. 1 illustrates an exemplary wall paneling assembly 10 in accordance with this invention. As shown, a plurality of panel pieces are provided, each having four edges, the top edge of which includes a groove and the bottom edge, an accommodating tongue. This tongue and groove arrangement and the assembly of the individual panel pieces is discussed hereinbelow in detail and it is further illustrated in FIGS. 1–3 and FIGS. 10–13.

Included in the wall paneling system of FIG. 1, are molding pieces which can be added to the assembled panels as a finishing touch to enhance the visual effect. A typical top molding piece 4 includes a tongue that is inserted into the groove of a topmost panel 2 (FIG. 1).

In the same manner, a bottom molding piece 6 having a flat surface and equipped with an accommodating groove can be used as a base member and fitted into the tongue of a bottom panel 8 (FIG. 1).

In this assembly 10, the panel pieces of each wall terminate at their respective corners some small distance from one another and they form that space which is shown as 12 in FIG. 1. The object of space 12 is to make allowance for any shifting or movement in the support structure. Moreover, it has been found, in practice, that installation is facilitated when adjoining walls are not so closely fitted as to abut against one another.

In their assembled mode, the panels of this invention exhibit those accent lines which are shown as 14 in FIG. 1 and they are registry with the accent lines of adjacent panel pieces; however, this is an optional feature and, in practice, the accent lines 14 can be made virtually invisible by bringing the panel pieces into abutting contact.

The panel pieces of this invention may be mounted onto any suitably secure structure, solid or framed. Typical of such structures are, for example, stationary walls, elevator walls or the like.

In addition, the panel pieces may be attached to the framework of a stationary wall, an elevator wall, or the like, or the panel pieces can be attached to wall studs. The panel pieces may also be used as a cover to hide gaps in a wall. It will be appreciated, therefore, that the paneling assembly of this invention is not limited to any particular form of wall structure.

Figure 2:
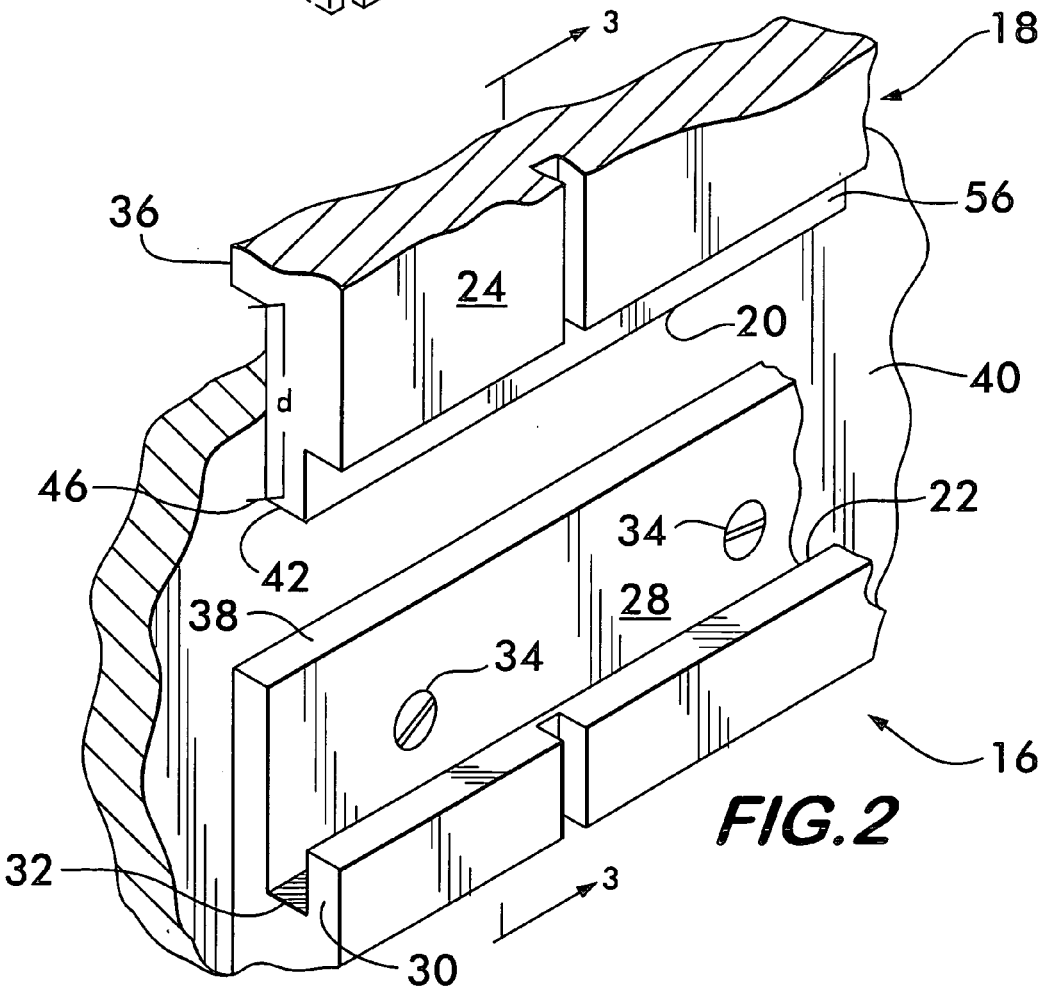
FIG. 2 is fragmentary isometric view of two unassembled panel pieces one of which is secured to a support structure.
Figure 3:
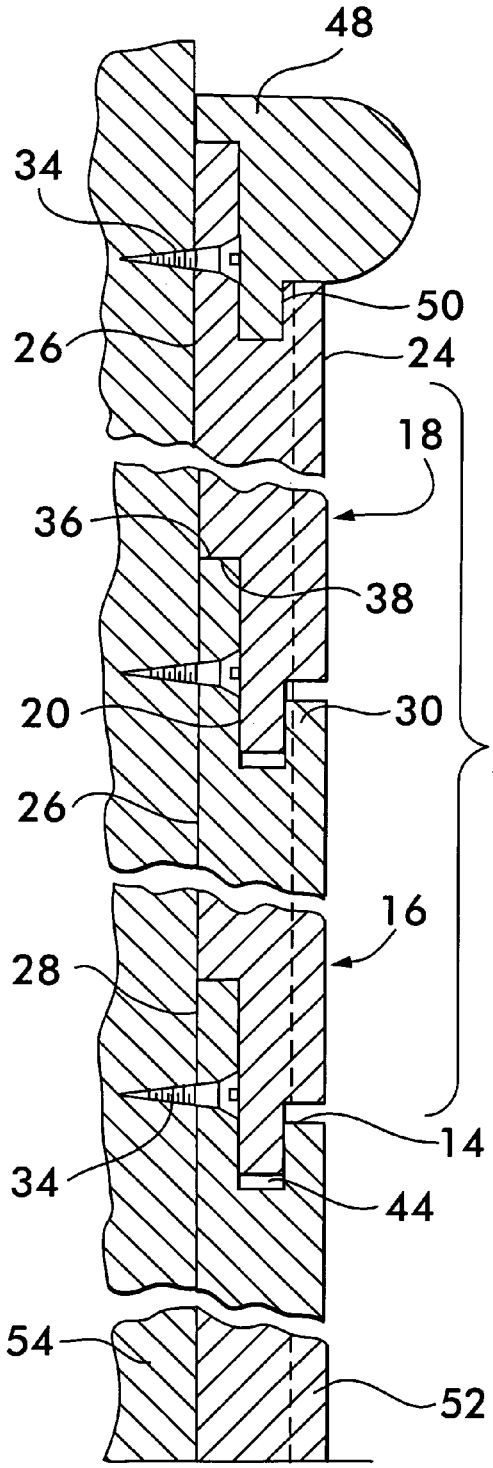
FIG. 3 is a cross-sectional assembled side view of the panel pieces shown in FIG. 2 taken along line 3—3.

FIGS. 2 and 3 illustrate that embodiment in which assembly is achieved by inserting the elongate projection or tongue 20 of one panel 18 into the elongate recess or groove 22 of a like panel 16. As shown in FIGS. 2 and 3, a typical panel piece consists essentially of a front side 24, a rear side 26 and two accommodating edge faces which can be interlockingly joined to a like panel.

One edge face is in the form of an elongated projection or tongue 20 which extends longitudinally from the rear side 26 of the panel piece 16 so that the rear wall of the tongue is coextensive with the rear wall of the panel 16. The opposing panel edge is an elongated recess or groove 22 defined by a rear leg 28, front leg 30 and the recessed base member shown as 32 in FIG. 2. The rear side of leg 28 is also coextensive with the rear wall of the panel piece 16 and its dimensions are such that the length of the rear leg 28 is greater than that of leg 30.

In general, assembly is achieved by securing a first panel to a wall or similar support structure and mating it to a second panel piece and this process is repeated with any desired number of panel pieces.

The installation of a typical paneled assembly is described with particuarlity hereinbelow by making reference to a wall as the support structure. Also, screws are described as the fastening means; however, the reference to a 'wall' and 'screw means' is for illustration only and those skilled in the art will appreciate that any suitable support and any suitable fastening means may be substituted therefor without departing from the spirit or scope of this invention.

Typical of those fastening means which may be employed include, for example, nails, clips, rivets, staples or adhesives and the like.

In practice, in a typical installation, the panel pieces are placed one atop the other and secured to a wall by screws which are inserted through preformed apertures. Once this has been done, a second panel piece 18 is laid against the first and its tongue is snugly inserted into the mating recess or groove 22 of the first panel piece 16.

The tongue is neatly received by the groove but it is significant to note that the only interface which occurs is a mating of flange 36 with shoulder 38 and the engagement of the two panels' respective sidewalls, that is, the sidewall 56 of tongue 20 and the front sidewall of recess 22.

Equally significant is the fact that the depth of recess 22 is greater than the length of tongue 20 and no contact occurs between the terminal ends of their respective edge faces; instead, the base of the tongue 42 and the base of the groove 32 are separated from one another by that area or space which is shown as 44 in FIG. 3.

The space 44 is significant because it serves to separate the tongue end of one panel from the groove base of a matching panel and thus avoids that cantilever force which is associated with prior art paneling systems, that is, the force which results when the tongue end of one panel comes into abutting contact with the groove base of an adjoining panel. In the present invention, the assembled panels rely for their support on the contact between flange 36 of panel 16 and shoulder 38 of panels 18. This contact and the shear force absorbed by the mounting screws 34 virtually eliminates the cantilever force effect associated with existing panel structures.

In addition to improving on existing panel systems, the present invention also affords an improvement in aesthetics and design. This is seen when two panels are joined together, in the manner described hereinabove, that is, one atop the other, in which event their adjoining front faces form an elongate space which, in the completed assembly gives the appearance of an accent line 14. This accent line can also be enhanced by using contrasting color schemes as, for example, by coloring the panel surfaces with light hues and using darker tones or the color black to highlight those elongate areas which form the accent line 14.

Although size is not important, it is critical to this invention that the rear leg 28 of each panel (FIG. 2) be of such dimension as to exceed that of tongue 20 and that the distance which is defined by the underside of flange 36 and the terminal end 46 of tongue 42 (FIG. 2). This parameter is shown as "d" in FIG. 2.

The rear leg 28 also serves as the mounting means for securing the panel pieces to a wall or other support structure. Accordingly, the rear leg must provide sufficient surface area for forming apertures to accommodate mounting screws or nails or the like.

If screws or nails are employed, their heads are conveniently covered by the tongue 20 of an adjoining panel piece as shown in FIG. 3.

Also shown in FIG. 3, is a top molding piece 48 fitted into tongue 50 of an accommodating panel as a finishing piece. This is an optional feature but, if omitted, the screws 34 would, under normal conditions, be hidden from view by the front leg of the top panel piece 18.

Also shown in FIG. 3 is a flat edged bottom panel 52 which is installed as a finishing piece so as to bring the bottom panels into registry with the floor surface.

The following two paragraphs describe a typical embodiment for installing the paneling assembly of this invention onto a wall.

A panel having a flat bottom edge 52 is placed on the floor of the room which is being paneled adjacent to the wall 54 (FIG. 3) and a screw 34 is driven through a screw hole (not shown in FIG. 3) of the rear leg of the panel piece. The panel pieces which are being attached to a wall are positioned in such manner that the screw holes are in registry with the frame or studs in the wall structure.

A second panel piece, shown in FIG. 3 as item 16, is attached to the bottom panel piece 52 by fitting the tongue 26 of the latter into the groove 24 of the former, and this attachment means is repeated for all subsequent panel pieces until the room is fully paneled. Thereafter, a molding piece 48 is attached to the topmost panel 18 by inserting the tongue 50 of said molding into the groove of the panel.

Figure 4:
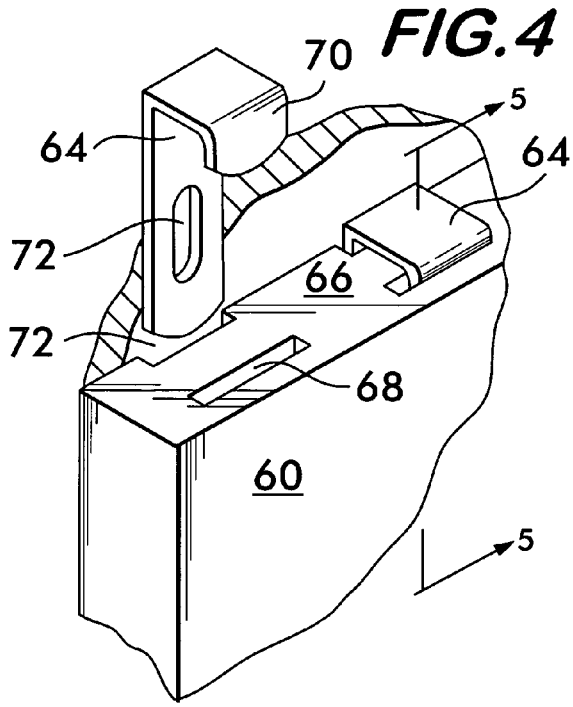
FIG. 4 is a fragmentary perspective view of a top panel piece shown with fastening devices in various stages of engagement.
Figure 5:
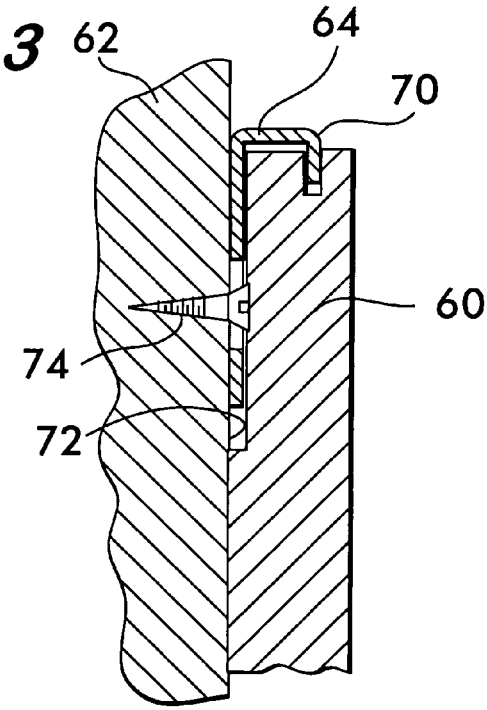
FIG. 5 is a cross-sectional side view of the top panel piece of FIG. 4 taken along line 5—5.

FIGS. 4 and 5 illustrate an alternative means for securing the panel pieces to a support structure. In this embodiment, the topmost panel piece 60 is secured to a wall 62 by the use of clips 64.

As illustrated in FIG. 4, the top panel piece 60 is defined by a flat surface 66 into which has been formed slotted openings 68 for receiving the hook ends 70 of the clip which is to be inserted. Also included in the clip 64 is an elongated slot 72 through which a screw 74 can be driven for mounting the clip and panel to a wall 62.

As shown in FIG. 5, the rear side of panel 60 also includes a recess 72 for receiving the clip 64. This recess 72 allows the top panel piece 60 to lay flush against the wall 62.

Although two clips are shown in FIG. 5, the number used for each panel piece may vary depending on the size and weight of the panel.

FIGS. 6 and 7 illustrate the use of clips 80 for attaching a bottom panel piece 82 to a wall 84. In this embodiment, the clip 80 contains a plurality of screw holes 86 and 88. The bottom surface 90 of the panel 82 is flat and includes slotted openings 92 and 94 for receiving the hook ends 96 of the clip 80. In practice, the clip 80 is secured to the wall by means of screws 98 and 100 which are inserted through the screw holes 86 and 88. Thereafter, the bottom panel piece 82 is inserted onto the clip 80 and the hook member 96 of the clip 80 is inserted into the slotted opening 94.

In this embodiment, the bottom panel piece 82 is in close proximity to the floor 102 so as to make allowance for clip 80. Also, the rear side of the panel 82 includes a recess 104 into which the projection of the clip 80 may be fitted. The recess 104 allows the panel to lay flush against the wall 84 when placed over the clips 80.

Although two mirror clips 80 are shown in this embodiment, the number of clips may vary depending on the size and weight of the panel piece 82.

FIGS. 8 and 9 illustrate the use of a Z clip 110 for attaching a top panel piece 112 to a wall 114. This Z clip 110 is attached to the panel piece 112 with the open end of the Z clip 110 facing downwards. A second Z clip 116 is attached to the wall 114 with its open end facing upwards. These Z clips 110 and 116 are attached to the panel piece 112 and the wall 114 by screw means 118.

To achieve assembly, the open end of Z clip 110 is mated to the open end of Z clip 116. Also, in this assembly, it is to be noted that a recess 120 is formed into the rear side of the panel piece 112 so that it may accommodate the Z clip and at the same time, lay flush against the wall 114. Again, the number of clips 116 employed will vary depending on the size and weight of the panel piece 90.

Another embodiment of this invention is illustrated in FIG. 10, which shows a panel piece 130 containing two tongues 132 and two grooves 134 located on the top and left edge of the panel piece. The grooves 134 each contain a rear leg 136 and a front leg 138. The tongues 132 are located on adjacent edges of the panel piece 130 and the grooves 134 are located on the adjacent edges of the same panel piece 130 opposite the edges containing the tongues 132. It is to be understood that such an arrangement is exemplary and the number and placement of the tongue/groove combinations is discretionary.

The panel pieces 130 in this embodiment provides for the tongue and groove attachment of panel pieces in a horizontal as well as vertical arrangement so that a wall which is much larger than the individual panel pieces may be covered. In its assembly, the tongues 132 are inserted into the grooves 134 of previously assembled panel pieces 130 and screws 140 are threaded into accommodating screw holes 142 in the rear leg 136 of the panel piece 130. Thereafter, the tongues 132 of additional panel pieces can be inserted into the screwed in grooves 134 of the previously attached panel pieces.

While the size of the panel pieces 130 is discretionary, a wall paneling assembly that utilizes both horizontal and vertical tongue and groove members will usually employ panels 130 whose length is greater than their height.

Another embodiment of this invention provides for a panel piece whose opposing edge faces are beveled to accommodate the matching edge face of a like-configured panel.

When such a panel is mated with the face of a second like-configured panel, their respective beveled recesses fit neatly one into the other and a mating of the panel pieces is achieved. This embodiment is illustrated in FIGS. 11 and 12.

As shown in FIGS. 11 and 12, the panel piece 150 is defined by a front side 152, a rear side 154 and an edge face having a beveled recess 156. The beveled recess 156 of this edge face, extends from one side of the panel piece to the other and it is defined by a projecting first flange 158 whose outer wall is coextensive with the front side 152 of the panel piece 150.

The mating of one panel piece to another is achieved by mating the beveled recess of panel piece 150 with the beveled recess of a second panel piece 160. The edge face of this second panel matches the beveled recess formed in the edge face of the first panel piece 150 and it is defined by a projecting second flange 162 whose outer wall is coextensive with the rear side of the panel piece. This projecting second flange 162 is greater in height than that of first flange 158 so that when the respective recesses of both panel pieces are assembled (FIG. 12), an elongate space is formed between the end member of flange 158 and the shoulder 166 of panel 160.

The interrelationship between the beveled recesses of the joined panel pieces results in a firm fit; however, the feature which is most critical to this assembly lies in their respective flange members 158 and 162. As shown in FIG. 12, the bottom side 164 of flange 158 does not engage the shoulder 166 of panel piece 160, as a result of which, an elongate recess or space is created between these two panel pieces.

This elongate space is an accent line and it also has the salutary effect of eliminating that cantilever force which is associated with known panel assemblies. Instead of a cantilever force, the adjoined panel pieces fit neatly at their beveled recess faces and this match converts the cantilever effect into a shear force which is distributed evenly over the full extent of the opposing edge faces.

In another embodiment of this invention, the panel pieces of the wall paneling assembly contain a covering. This covering may be plastic laminate, glass, stone, sheet metal, stainless steel, brass, paint, marble, veneer or a solid surface material such as Corian®. Also, while the actual panel pieces can be derived from any source, the preferred materials are plywood, flakeboard and foam.

In yet another embodiment of this invention, the rear of the panel pieces is laminated with a backer sheet.

Any wall may be paneled by the wall paneling assembly and system of the current invention. The wall may be solid, such as plasterboard, or it may be a frame, studs or some combination thereof or the like.

This invention has been described by reference to precise embodiments, but it will be appreciated by those skilled in the art that this invention is subject to various modifications, and to the extent that those modifications would be obvious to one of ordinary skill, they are considered as being within the scope of the appended claims.

What is claimed is:

1. A wall panel assembly mountable on a structure and comprised of a plurality of interengageable panel pieces, each of said panel pieces comprising:

a front side;

a rear side;

a first edge having a tongue extending lengthwise therealong and projecting outwardly therefrom substantially co-planar with said panel piece, a first flange being positioned between said tongue and said rear side, a second flange being positioned between said tongue and said front side; and a second edge positioned opposite to said first edge and having a groove extending lengthwise therealong, said groove being defined by a rear leg positioned adjacent to said rear side, a front leg positioned in spaced relation to said rear leg and adjacent to said front side, and a base extending between said legs, said rear leg extending further from said base than said front leg such that, upon engagement of said tongue of one of said panel pieces within said groove of another of said panel pieces, said first flange engages said rear leg, said tongue is sized so as to remain in spaced apart relation away from said base, said second flange is sized so as to remain in spaced apart relation away from said front leg, and said tongue of said one panel piece is captured between said front and rear legs of said other panel piece.

2. A wall panel assembly according to claim 1, wherein said tongue on each said panel piece extends substantially along the entire length of said first edge.

3. A wall panel assembly according to claim 1, wherein said groove on each said panel piece extends substantially along the entire length of said second edge.

4. A wall panel assembly according to claim 1, further comprising a plurality of apertures extending through said rear leg on each said panel piece, said apertures being positioned in spaced apart relation lengthwise along said rear leg for receiving fasteners therethrough for attachment of said panel pieces to said structure.

5. A wall panel assembly according to claim 1, wherein each of said panel pieces is formed from a laminate.

6. A wall panel assembly according to claim 5, wherein said laminate comprises wood and non-wood materials.

7. A method of installing a wall panel assembly onto a support structure, said method comprising the steps of:

providing a plurality of panel pieces, each said panel piece comprising:

a front side;

a rear side;

a first edge having a tongue extending lengthwise therealong and projecting outwardly therefrom substantially co-planar with said panel piece, a first flange being positioned between said tongue and said rear side, a second flange being positioned between said tongue and said front side;

a second edge positioned opposite to said first edge and having a groove extending lengthwise therealong, said groove being defined by a rear leg positioned adjacent to said rear side, a front leg positioned in spaced relation to said rear leg and adjacent to said front side, and a base extending between said legs, said rear leg extending further from said base than said front leg;

attaching at least one of said panel pieces to said support structure; and engaging said tongue of another of said panel piece within said groove of said one panel piece, said first flange of said other panel piece thereby engaging said rear leg of said one panel piece, said tongue being sized so as to remain in spaced apart relation away from said base on said one panel piece, and said second flange of said other panel piece being sized so as to remain in spaced apart relation away from said front leg on said one panel piece, said tongue of said other panel piece being captured between said front and rear legs of said one panel piece.

8. In combination, an elevator positionable within an elevator shaft, and a wall panel assembly, said combination comprising:

an elevator cab movable vertically within said elevator shaft, said elevator cab having an interior;

a plurality of interchangeable panel pieces mounted to said elevator cab within said interior, each of said panel pieces comprising:

a front side;

a rear side interfacing with said elevator cab;

a first edge having a tongue extending lengthwise therealong and projecting outwardly therefrom substantially co-planar with said panel piece, a first flange being positioned between said tongue and said rear side, a second flange being positioned between said tongue and said front side; and a second edge positioned opposite to said first edge and having a groove extending lengthwise therealong, said groove being defined by a rear leg positioned adjacent to said rear side, a front leg positioned in spaced relation to said rear leg and adjacent to said front side, and a base extending between said legs, said rear leg extending further from said base than said front leg such that, upon engagement of said tongue of one of said panel pieces with said groove of another of said panel pieces, said first flange engages said rear leg, said tongue is sized so as to remain in spaced apart relation away from said base, said second flange is sized so as to remain in spaced apart relation away from said front leg, and said tongue of said one panel piece is captured between said front and rear legs of said other panel piece.

* * * * *